US006779355B2

(12) United States Patent
Tanaka

(10) Patent No.: US 6,779,355 B2
(45) Date of Patent: Aug. 24, 2004

(54) REFRIGERATION DEVICE

(75) Inventor: Shigeto Tanaka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 42 days.

(21) Appl. No.: 10/332,769

(22) PCT Filed: Apr. 30, 2002

(86) PCT No.: PCT/JP02/04343

§ 371 (c)(1),
(2), (4) Date: Jan. 13, 2003

(87) PCT Pub. No.: WO02/090843

PCT Pub. Date: Nov. 14, 2002

(65) Prior Publication Data

US 2003/0145614 A1 Aug. 7, 2003

(30) Foreign Application Priority Data

May 1, 2001 (JP) ..... 2001-134057

(51) Int. Cl.[7] ..... F25B 31/00
(52) U.S. Cl. ..... 62/192; 62/228.5
(58) Field of Search ..... 62/192, 193, 228.5, 62/216, 217, 222, 224, 225

(56) References Cited

U.S. PATENT DOCUMENTS 3,808,829 A * 5/1974 Peruglia ..... 62/217
4,485,634 A * 12/1984 Yasuda et al. ..... 62/196.2
4,888,957 A * 12/1989 Chmielewski ..... 62/84
6,047,556 A * 4/2000 Lifson ..... 62/196.2
6,354,092 B1 * 3/2002 Young et al. ..... 62/83

FOREIGN PATENT DOCUMENTS

| | | |
|---|---|---|
| JP | 4-28958 A | 1/1992 |
| JP | 6-241580 A | 8/1994 |
| JP | 8-128763 A | 5/1996 |
| JP | 3031218 B2 | 2/2000 |

OTHER PUBLICATIONS

Translation of JP 06–241580 A (Hiroki et al.) supplied by Applicant in paper #4, Aug. 30, 1994, 7 pages.*

* cited by examiner

*Primary Examiner*—Marc Norman

(57) ABSTRACT

A refrigeration circuit (1) sequentially connected to a compressor (10), a condenser (11), an electric expansion valve (13), an evaporator (17), and an intake proportional valve (21). When the freezing capability of the refrigeration device is to be suppressed, a control means (30) will restrict the intake proportional valve (21) in order to place refrigerant in a discharge side of the evaporator (17) in a wet saturated steam state, and the electric expansion valve (13) will be set to an aperture such that the refrigerant in the interior of the evaporator (17) will be placed in the wet saturated steam state.

5 Claims, 2 Drawing Sheets

REFRIGERATION DEVICE

TECHNICAL FIELD

The present invention relates to a refrigeration device, and more particularly to a refrigeration device that is capable of both freezing and chilling.

BACKGROUND ART

Refrigeration devices that are employed in containers and the like are not only capable of freezing but are also capable of chilling, i.e., maintaining a temperature that is slightly above the freezing point.

In this type of refrigeration device, the compressor must have a sufficiently large freezing capability in order to freeze items in the refrigeration device. On the other hand, there is less demand on the compressor during chilling than there is during freezing because the temperature differential between the outside air and the interior of the refrigeration device is small. Thus, the compressor is stopped during chilling, and this suppresses the capabilities of the refrigeration unit.

However, when the freezing capability of the refrigeration unit is suppressed in this manner during chilling, the compressor is frequently started and stopped in order to control the temperature inside the refrigeration device, and as a result the lifespan of the compressor is shortened. In addition, there will be large changes in temperature when it is controlled by starting and stopping the compressor, and this characteristic is not desirable in a refrigeration unit that is required to maintain a constant temperature.

Because of this, it is desirable that the compressor run as continuously as possible while suppressing the capability of the refrigeration unit. The following means are used to accomplish this. An intake proportional valve is placed on the intake side of the compressor in a refrigeration circuit, and by closing this intake proportional valve, the amount of refrigerant supplied to the compressor can be suppressed. When this is done, the amount of refrigerant in the compressor is reduced, and thus the freezing capability of the refrigeration device is reduced. Thus, the freezing capability of the refrigeration device can be controlled while continuously operating the compressor.

In addition, a thermo-sensitive expansion valve is employed in conventional refrigeration devices. The thermo-sensitive expansion valve has a thermo-sensitive line that is disposed near the outlet of the evaporator, and the temperature of the refrigerant near the outlet of the evaporator is slightly hotter than normal. Because of this, the temperature near the inlet inside the evaporator will be different then the temperature near the outlet. This is because the thermo-sensitive expansion valve places the refrigerant near the outlet in the superheated steam state, but places the refrigerant near the inlet in the wet saturated steam state. Thus, when a thermo-sensitive expansion valve is used as an expansion valve, a temperature distribution will be produced inside the evaporator.

In this situation, because the freezing capability of the refrigeration unit is being controlled during chilling, as noted above, the temperature distribution in the evaporator is largely responsible for creating a temperature distribution inside the refrigeration unit. Because of, this, a non-uniform temperature distribution inside the refrigeration unit will occur easily when a temperature distribution is produced in the evaporator.

DISCLOSURE OF THE INVENTION

It is an object of the present invention to provide a refrigeration device that maintains the temperature inside the refrigeration unit at a stable level when the freezing capability of the refrigeration device is being suppressed.

The refrigeration device according to a first aspect of the present invention is made of a refrigeration circuit, control means, and command means. The refrigeration circuit is sequentially connected to a compressor, a condenser, an electric expansion valve, an evaporator, and an intake proportional valve. The control means controls the capacity of the refrigerant circuit. The command means provides commands to the control means. Furthermore, when the control means receives a request to suppress the capabilities of the refrigerant circuit from the command means, the intake proportional valve will be restricted in order to place the refrigerant in the discharge side of the evaporator in the wet saturated steam state, and the electric expansion valve will be set to an aperture such that the refrigerant in the interior of the evaporator will be placed in the wet saturated steam state.

In this refrigeration device, the intake proportional valve will be restricted by the control means during chilling. When this occurs, refrigerant in the wet saturated state will be collected in the outlet of the evaporator. Thus, the freezing capability of the refrigeration device will be suppressed and chilling will be made possible because the amount of refrigerant circulating in the refrigerant circuit will be reduced.

Furthermore, the interior of the evaporator can be filled with refrigerant in the wet saturated state by setting the aperture of the electric expansion valve such that the refrigerant is in the wet saturated steam state. Refrigerant in the wet saturated state will be at a constant temperature due to the equal pressure inside the evaporator. This allows the temperature of the evaporator to be uniform both when the freezing capability of the refrigeration device is suppressed and when freezing takes place, and makes it difficult to generate temperature irregularities. Thus, the temperature inside the refrigeration device can be maintained at a stable level.

Note that when a thermo-sensitive expansion valve is used conventionally as an expansion valve, the temperature distribution inside the evaporator will not be uniform because the expansion valve will regulate the refrigerant such that it will enter the superheated steam state near the outlet of the evaporator. However, the refrigerant in the evaporator can be placed in the wet saturated state and a uniform temperature distribution inside the evaporator can be achieved because an electric expansion valve is employed in the present invention.

The refrigeration device according to a second aspect of the present invention is the refrigeration device of the first aspect, and further includes a protection means that prevents damage to the compressor.

When the freezing capability of the refrigeration device is suppressed and chilling takes place, there are times when damage to the compressor will occur. For example, when non-compressible liquid refrigerant flows therein, it is possible to damage the compressor when it generates high pressures. Furthermore, the amount of lubricating oil inside the compressor will be reduced, thus making it easy to bum the compressor, because the lubricating oil will be driven out of the compressor by the liquid refrigerant.

Various types of damage to the compressor can be prevented because of the presence of the protection means in the refrigeration device.

The refrigeration device according to a third aspect of the present invention is the refrigeration device of the second aspect, wherein the protection means includes a sensor that detects the pressure and temperature of the refrigerant in the discharge side of the compressor, and will deduce the pressure and temperature of the refrigerant in the intake of the compressor based upon the detection results from the sensor.

A sensor that detects the temperature and pressure of the refrigerant in the discharge side of the compressor is provided as the protection means. The pressure and temperature of the refrigerant in the intake of the compressor will be deduced from the detection results of the sensor. The pressure and temperature deduced therefrom will be used to, for example, regulate the electric expansion valve and the intake proportional valve, and to prevent the refrigerant in the intake of the compressor from entering the liquid state. This will prevent damage to the compressor.

The refrigeration device according to a fourth aspect of the present invention is the refrigeration device of the second aspect, in which the protection means includes an oil temperature sensor that detects the temperature of oil in the compressor, and will deduce the degree of wetness of the refrigerant in the intake of the compressor based upon the detection results from the oil temperature sensor.

Here, the degree of wetness of the refrigerant in the intake of the compressor will be deduced from the detection results from the oil sensor serving as the protection means. The pressure and temperature deduced therefrom will be used to, for example, regulate the electric expansion valve and the intake proportional valve, and to prevent the refrigerant in the intake of the compressor from entering the liquid state. This will prevent damage to the compressor.

BEST MODE FOR CARRYING OUT THE INVENTION

Overall Structure of the Refrigeration Device

Figure 1:
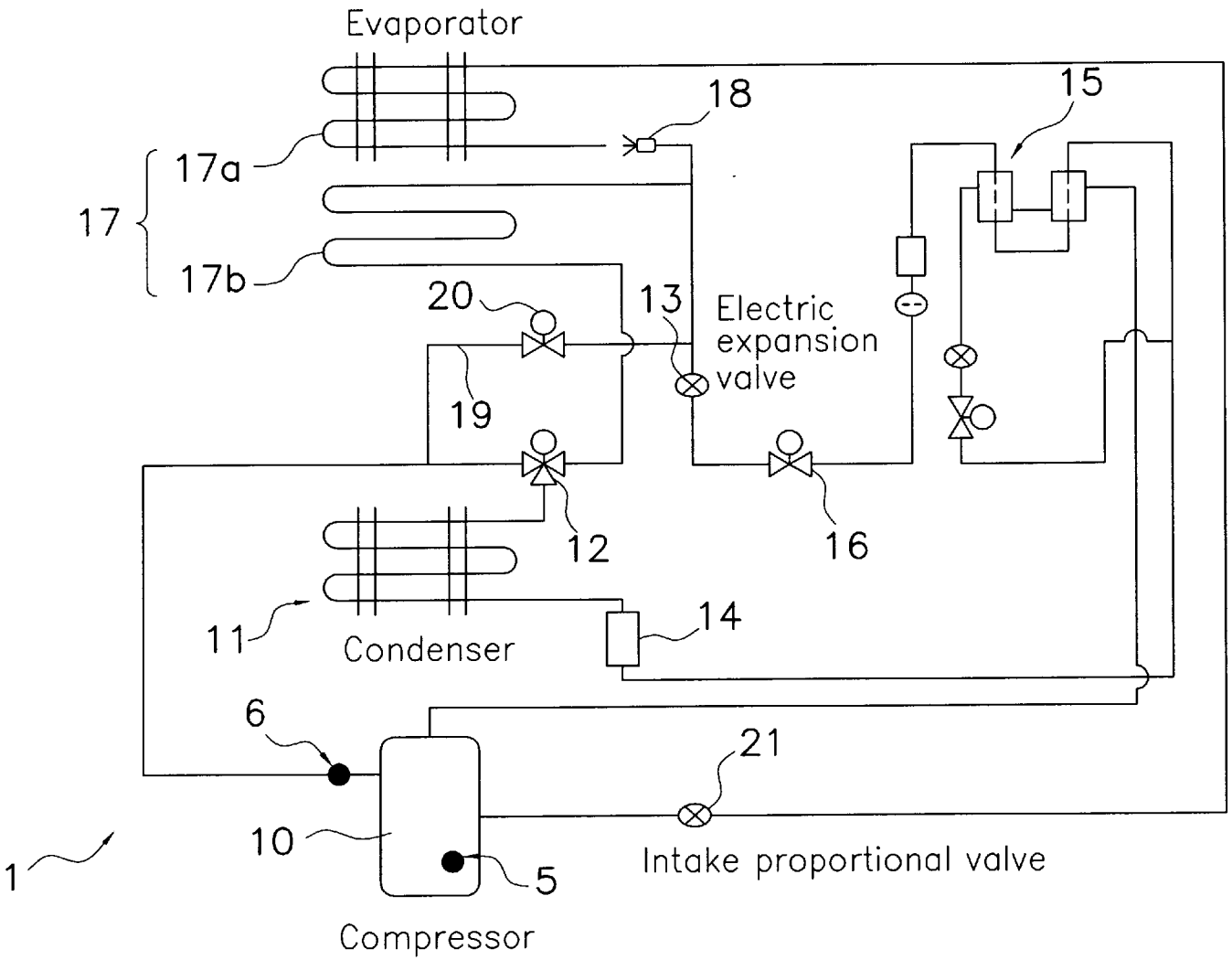
FIG. 1 is a schematic view of the refrigeration device according to one embodiment of the present invention.

A schematic diagram of the refrigeration device according to the present invention is shown in FIG. 1.

Figure 2:
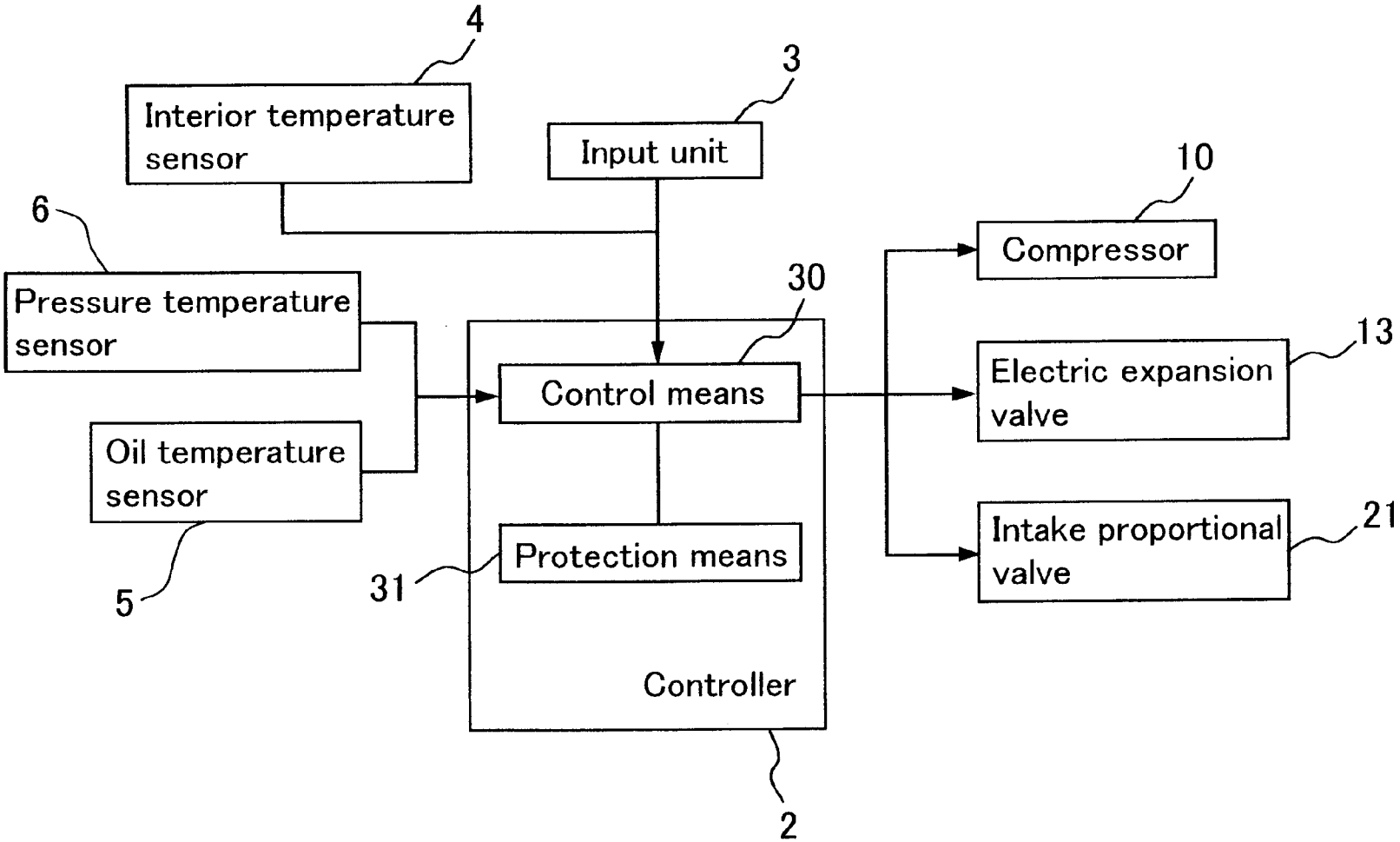
FIG. 2 is a control block diagram of the refrigeration device according to one embodiment of the present invention.

The refrigeration device according to the present invention has a refrigeration circuit 1, and as further shown in FIG. 2, is comprised of a controller 2, an input unit 3, and an internal temperature sensor 4.

The refrigerant circuit 1 is comprised of a compressor 10, a condenser 11, an electric expansion valve 13, an evaporator 17, and an intake proportional valve 21, and are connected in sequence to each other by means of piping.

The compressor 10 is a device that compresses refrigerant in the vapor state, and includes an oil temperature sensor 5 therein, and a pressure temperature sensor 6 on the discharge side thereof. The oil temperature sensor 5 is a device for detecting the temperature of the lubricating oil in the compressor 10.

The condenser 11 is a device that removes heat from the refrigerant and radiates that removed heat away therefrom. The condenser 11 is connected to the discharge side of the compressor 10 via a three way directional control valve 12.

In addition, the electric expansion valve 13 is a device that expands the refrigerant that passes therethrough and lowers the pressure and temperature thereof, and is provided on the outlet side of the condenser 11. Note that a receiver 14, an auxiliary heat exchanger 15, and an open/close valve 16 are provided between the condenser 11 and the electric expansion valve 13.

The evaporator 17 absorbs the heat from the interior of the refrigeration device and transfers the heat to the refrigerant, and is provided on the outlet side of the electric expansion valve 13. A distributor 18 is provided between the evaporator 17 and the electric expansion valve 13. Note that the evaporator 17 is comprised of a main evaporator 17*a* and a sub-evaporator 17*b*, with the sub-evaporator 17*b* being provided between the electric expansion valve 13 and the condenser 11.

Note also that a bypass circuit 19 is provided between the discharge side of the compressor 10 and the evaporator 17, and a bypass valve 20 is provided in the bypass circuit 19.

The intake proportional valve 21 is a device that regulates the amount of refrigerant in circulation, and is provided on the intake side of the compressor 10.

A system block diagram of the refrigeration device is shown in FIG. 2.

The controller 2 in the refrigeration device is a microcomputer, and includes a control means 30 and a protection means 31. The control means 30 controls the refrigeration device, and the protection means 31 serves to protect against damage to the compressor 10. The control means 30 is connected to the input unit 3 used to set the temperature inside the refrigeration unit, the internal temperature sensor 4 that detects the temperature inside the refrigeration unit, the oil temperature sensor 5, and the pressure temperature sensor 6. In addition, the compressor 10, the electric expansion valve 13, and the intake proportional valve 21 are connected to the control means 30.

Operation

The internal temperature of the refrigeration device is controlled by the control means 30. First, the cooling of the refrigeration device will be described.

Freezing

The refrigeration device is a device that removes heat from the interior thereof and radiates it to the exterior thereof by circulating refrigerant in the refrigerant circuit 1. The circulation of the refrigerant in the refrigerant circuit 1 will be described below.

First, the refrigerant absorbs the heat inside the refrigeration device by means of the evaporator 17. The refrigerant that has absorbed this heat is sent to the compressor 10 via the intake proportional valve 21. The refrigerant is compressed into a high temperature high pressure gas in the compressor 10, and sent to the evaporator 11. The heat in the refrigerant is radiated to the exterior of the refrigeration device in the evaporator 11, thereby lowering the temperature thereof. Thus, the heat that was absorbed by the refrigerant in the evaporator 17 will be removed by the condenser 11. In addition, the refrigerant is sent from the condenser 11 to the electric expansion valve 13 and expanded, and then returned to the evaporator 17.

The control means 30 controls both the amount of refrigerant in circulation in the refrigerant circuit 1 and the temperature inside the refrigeration device by controlling the compressor 10, the electric expansion valve 13 and the intake proportional valve 21. During freezing, there is a large amount of refrigerant in circulation, and the heat inside the refrigeration device is removed to the exterior thereof in accordance with the temperature set in the input unit 3.

Chilling

On the other hand, during chilling the freezing capability of the refrigeration device is suppressed in order to bring the temperature inside the refrigeration unit to a point just above the freezing point. The means of suppressing the freezing capability will be described below.

In order to suppress the freezing capability, the intake proportional valve 21 will first be restricted. Thus, the refrigerant in the line up to the intake proportional valve 21 can be collected in the wet saturated state, and the amount of refrigerant circulating in the refrigerant circuit 1 can be controlled. In addition, in this state even the refrigerant in the outlet of the evaporator 17 can be placed in the wet saturated state by opening and regulating the electric expansion valve 13. Thus, the amount of refrigerant in circulation in the refrigerant circuit 1 can be reduced to a suitable level because the refrigerant in the line from the outlet of the evaporator 17 to the intake proportional valve 21 can be collected in the wet saturated state. Because of this, the freezing capability of the refrigeration device can be suppressed, and thus it can be operated in the chilling mode.

In addition, the refrigerant in the wet saturated state inside the evaporator 17 can be collected by further opening the electric expansion valve 13. At this point, the temperature of the refrigerant in the wet saturated state collected in the evaporator 17 will be constant because the pressure of the refrigerant inside the evaporator 17 is constant. Because the temperature of the refrigerant is constant, the heat absorbed from the interior of the refrigeration device in the evaporator 17 will be uniform. Thus, temperature irregularities inside the refrigeration unit can be suppressed.

Protection of the Compressor During Chilling

The refrigerant in the intake of the compressor is in the superheated steam state during freezing.

However, when suppressing the freezing capability and conducting chilling in the refrigeration device, the refrigerant in the intake of the compressor will be in the wet saturated state. Refrigerant in the wet saturated state includes refrigerant in the liquid state. Because liquids are different from gases and cannot be compressed, there is a risk that a pressure will be generated inside the compressor 10 that is higher than the maximum allowed, and thus creating damage therein, when there is a large amount of refrigerant in the liquid state in the compressor 10 during operation. Furthermore, there are times when refrigerant in the liquid state will force out the lubricating oil in the compressor 10 to the exterior thereof. If this occurs, the amount of lubricating oil in the compressor 10 will be reduced, thus creating the possibility that the compressor 10 will be burned.

Thus, the electric expansion valve 13 and the intake proportional valve 21 must be controlled by the control means 30 in order to place the refrigerant in the intake of the compressor 10 in the superheated steam state. Therefore, it is necessary to know the state of the refrigerant in the intake of the compressor 10, but this can be determined from the pressure and temperature of the refrigerant.

However, because there is little refrigerant in circulation, the pressure of the refrigerant in the inlet of the compressor 10 will be extremely low, a normal pressure sensor will give an inaccurate reading, and thus the current state of the refrigerant will be unclear.

Thus, the protection means 31 will deduce the pressure and temperature in the intake of the compressor 10 based upon the detection results from the oil temperature sensor 5 and the pressure temperature sensor 6. The superheated temperature of the refrigerant in the discharge side of the compressor 10 can be clearly determined by the pressure temperature sensor 6. The degree of wetness of the refrigerant in the intake of the compressor 10 can be determined by the degree that the refrigerant is superheated. Furthermore, because the degree of wetness of the refrigerant can be deduced by means of the results from the oil temperature sensor 5, it is possible to make a more accurate determination. Thus, the control means 30 can be used to control the freezing capability of the refrigeration device such that damage to the compressor 10 is avoided.

INDUSTRIAL APPLICABILITY

In the refrigeration device according to the first aspect, the temperature of the evaporator will be uniform when the freezing capability of the refrigeration device is suppressed and when freezing occurs, and temperature irregularities will be difficult to produce.

In the refrigeration device according to the second aspect, various types of damage to the refrigeration device can be avoided because of the presence of the protection means.

In the refrigeration device according to the third aspect, the refrigerant in the intake of the compressor can be prevented from entering the liquid state by the protection means because the pressure and the temperature of the refrigerant in the intake of the compressor will be deduced from the detection results of the sensors.

In the refrigeration device according to the fourth aspect, the refrigerant in the intake of the compressor can be prevented from entering the liquid state by the protection means because the degree of wetness of the refrigerant in the intake of the compressor will be deduced from the detection results of the oil temperature sensor.

What is claimed is:

1. A refrigeration device, comprising:

a refrigeration circuit being sequentially connected to a compressor, a condenser, an electric expansion valve, an evaporator, and an intake proportional valve;

a control means for controlling the capacity of said refrigerant circuit; and a command means for providing indicators to said control means;

said control means being configured to receive a request to control said capacity of said refrigerant circuit from said command means, said intake proportional valve being configured to be restricted to place refrigerant in a discharge side of said evaporator in a wet saturated steam state, and said electric expansion valve being configured to be set to an aperture to place refrigerant in an interior of said evaporator in said wet saturated steam state.

2. The refrigeration device set forth in claim 1, further comprising a protection means for preventing damage to the compressor.

3. The refrigeration device set forth in claim 2, wherein said protection means includes a sensor that detects a pressure and temperature of refrigerant in a discharge side of said compressor, and to deduce a pressure and temperature of refrigerant in an intake of compressor based upon the detection results from said sensor.

4. The refrigeration device set forth in claim 2, wherein said protection means includes an oil temperature sensor that detects a temperature of oil in said compressor, and to deduce a degree of wetness of refrigerant in an intake of said compressor based upon detection results from said oil temperature sensor.

5. The refrigeration device set forth in claim 1, wherein said interior of said evaporator is configured to be filled with said refrigerant in said wet saturated state by setting said aperture of said electric expansion valve such that said refrigerant is in said wet saturated steam state.

* * * * *